US005440956A

United States Patent [19]

Johnstun

[11] Patent Number: 5,440,956

[45] Date of Patent: Aug. 15, 1995

[54] UNIDIRECTIONAL GAS VALVE SHUTOFF TOOL AND METHOD

[76] Inventor: A. James Johnstun, 11801 Lampton View Dr., Riverton, Utah 84065

[21] Appl. No.: 181,856

[22] Filed: Jan. 14, 1994

[51] Int. Cl.[6] ..... B25B 13/48

[52] U.S. Cl. ..... 81/119; 81/176.1

[58] Field of Search ..... 81/119, 124.2, 124.3, 81/124.7, 186, 121.1, 176.1, 900, 176.15, 176.2

[56] References Cited

U.S. PATENT DOCUMENTS

| | | | |
|---|---|---|---|
| 726,782 | 4/1903 | Stone | 81/124.3 |
| 1,424,069 | 7/1922 | Blackmar | 81/124.3 |
| 1,424,178 | 8/1922 | Noyes | 81/119 |
| 3,010,346 | 11/1961 | Kulp | 81/124.2 |
| 4,715,252 | 12/1987 | Pella | 81/119 |
| 5,271,300 | 12/1993 | Zurbuchen et al. | 81/900 |

*Primary Examiner*—Bruce M. Kisliuk
*Assistant Examiner*—Joni Danganan
*Attorney, Agent, or Firm*—J. Winslow Young

[57] ABSTRACT

A unidirectional shutoff tool for closing a gas valve, having a valve stem with a rectangular profile extending from the gas valve. The tool has a head and a handle extending from the head to accommodate the application of leverage to the head. A rectangular receptacle is formed in one face of the head and has two diametrically opposed corners for engaging corresponding corners of the valve stem in order for the tool to be used to rotate the gas valve to the closed position. The receptacle is characterized by the absence of corners that could otherwise be used to engage corresponding corners of the valve stem thereby preventing the tool from being used to open the gas valve. The head is angularly offset from the handle to provide an ergonomically acceptable configuration for the tool. The head is also placed in a plane parallel to but spaced from the plane of the handle in order to adapt the placement of the receptacle over the valve stem in the absence of interference between the tool and the gas valve, the gas line, the gas meter, and the like.

10 Claims, 2 Drawing Sheets

UNIDIRECTIONAL GAS VALVE SHUTOFF TOOL AND METHOD

BACKGROUND

1. Field of the Invention

This invention relates to tools for use in shutting off a gas valve as a result of a catastrophe and, more particularly to a novel, unidirectional gas valve shutoff tool for shutting off a gas valve, the tool being unusable to open the gas valve.

2. The Prior Art

Millions of homes and businesses are supplied with natural gas or liquified petroleum gas (LPG) service for heating, cooking, and the like. Under ordinary circumstances these fuels are very safe and provide an economical source of heat energy. However, under catastrophic circumstances whether of a local or regional nature, it is an important safety step to be able to quickly and easily terminate the delivery of gas to the particular structure, whether a home or a business. For example, a local catastrophe could be a runaway automobile or truck crashing into the structure. An immediate concern is whether the force of the crash has damaged the gas service lines inside the structure allowing gas to escape. Escaping gas can either catch fire immediately or accumulate in enclosed spaces where its potential for subsequent detonation is extremely dangerous.

Other catastrophes that could seriously compromise the integrity of the gas service inside the structure include fires, earthquakes, tornadoes, wind storms, hurricanes, floods, and the like. Regardless of the origin of the damage to the structure it is of utmost urgency that a responsible person be able to quickly and easily stop gas flow into the structure. However, it is equally important from a safety standpoint that the gas valve should remain in the closed position until the gas lines inside the structure can be inspected by an authorized person.

One commercially available gas shutoff wrench is configured as a box end wrench having a cross-shaped aperture to enable the operator to either close or open the gas valve. However, a wrench having the capability of being used to reopen a gas valve is not a wrench that one should have immediately available adjacent a gas shutoff valve. Specifically, once the gas service has been shut off for whatever reason it should only be turned on again by a qualified service person. This is important since all pilot lights are, by law, designed to close upon the interruption of the gas service and should be relighted only by a qualified service person. Further, it is always important to check for leaks or faulty equipment prior to a resumption of the gas service.

In view of the foregoing, it would be an advancement in the art to provide a gas shutoff tool that can be held readily available adjacent the gas shutoff valve. It would be an even further advancement in the art to provide a gas shutoff tool that is fabricated from a nonsparking material such as hard rubber, plastic, brass, aluminum, or the like. More importantly, it would be an even further advancement in the art to provide a gas shutoff tool that is operable only to close a gas valve and has absolutely no other use or function. Such a novel apparatus and method is disclosed and claimed herein.

BRIEF SUMMARY AND OBJECTS OF THE INVENTION

This invention is a unidirectional tool that is operable only to shut off a gas valve and totally inoperable to reopen the gas valve. The tool is configured to engage diagonally opposing corners of the shutoff valve stem when the tool is used to close the gas valve. Corresponding corners otherwise necessary for reversing or opening the gas valve are removed to prevent the tool from being used to open the gas valve. The tool is fabricated from a corrosion resistant, nonsparking material such as hard rubber, plastic, brass, aluminum, or the like.

It is, therefore, a primary object of this invention to provide improvements in tools for shutting off a valve in a gas line.

Another object of this invention is to provide improvements in the method of closing the valve in a gas line.

Another object of this invention is to provide a tool for closing the valve in a gas line wherein the tool is inoperative to open the valve.

Another object of this invention is to provide a gas valve shutoff tool that has no other function than to close a gas valve.

Another object of this invention is to provide a tool for closing a valve in a gas line wherein the tool is fabricated from a nonsparking material such as hard rubber, plastic, brass, or aluminum.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
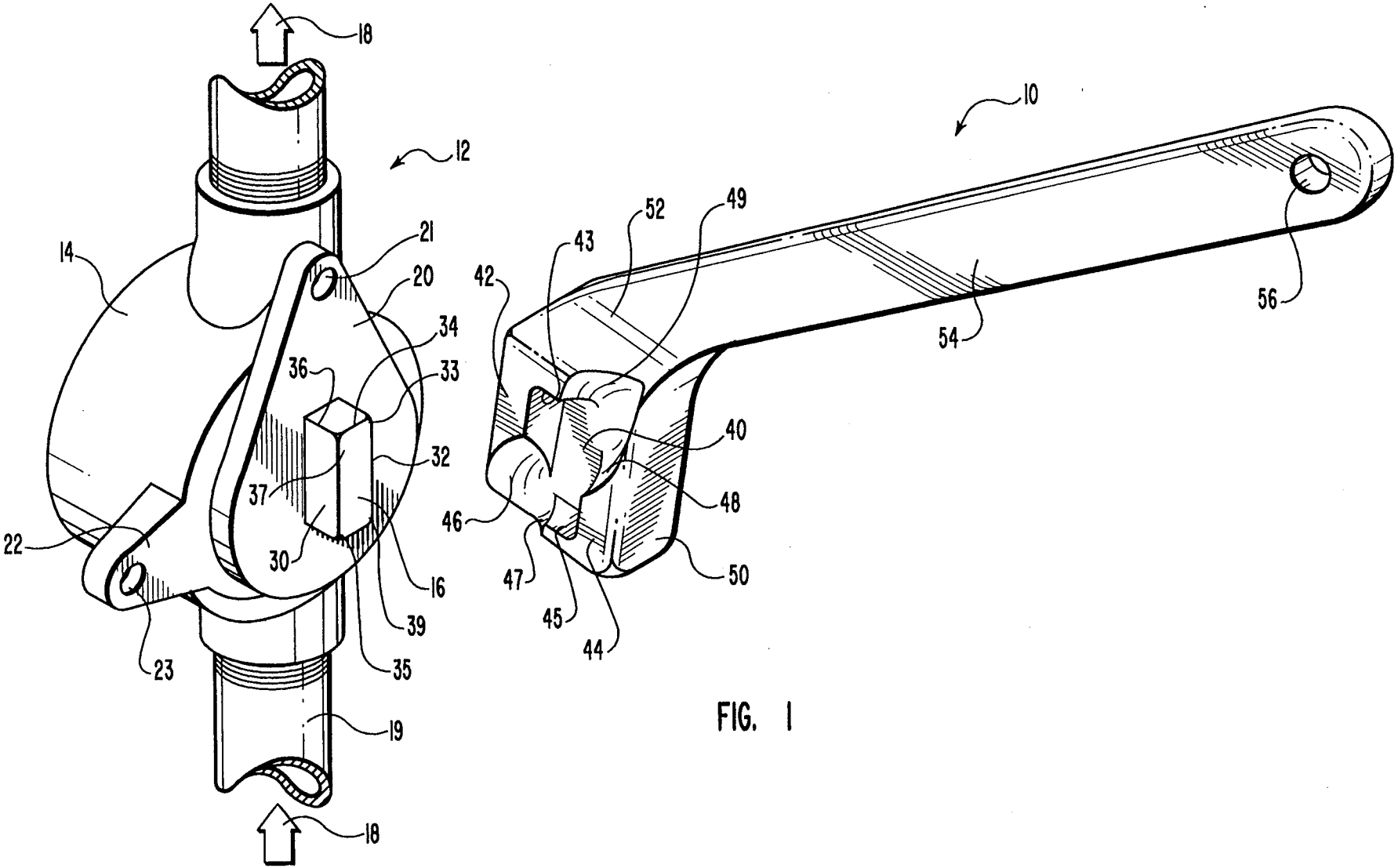
FIG. 1 is a perspective view of the novel tool of this invention shown in the environment of a shutoff valve for a gas line, the shutoff valve being shown schematically with a left hand perspective view with the tool shown in a right hand perspective view in order to more clearly illustrate the relationship of the tool to the valve.

The invention is best understood by reference to the drawing wherein like parts are designated by like numerals throughout in conjunction with the following description.

General Discussion

Shutoff valves for gas lines are configured as stopcock-like valves with a full open or a full closed position achieved by rotating the valve body through ninety degrees. Stops are built into the valve to limit travel of the valve body between these two positions. A valve stem extends outwardly from the valve body and is configured as a raised boss having a rectangular profile. The valve is configured to be in the open position when the longitudinal profile of the valve stem is oriented parallel to the gas line. The gas valve is closed when the longitudinal profile of the valve stem is orthogonal to the gas line. This feature provides an easily observed indication of whether the gas valve is open or closed.

Detailed Description

Referring now to FIG. 1, the novel shutoff tool of this invention is shown generally as tool 10 and is shown in the environment of a conventional gas valve shown generally as gas valve 12. Gas valve 12 is a conventional gas valve interposed in a gas line 19 and is shown schematically herein for ease of illustration of the novel features of tool 10. Gas valve 12 includes a valve housing 14 having a valve stem 16 extending outwardly therefrom. Valve stem 16 is configured as a raised boss having a rectangular, block-like profile as seen in this perspective view. Valve stem 16 extends outwardly from valve housing 14 to provide an engagement surface for the rotation of the valve body (not shown) inside valve housing 14. The internal configuration of gas valve 12 is a standard stopcock such that when valve stem 16 is rotated ninety degrees counterclockwise from its illustrated position, gas valve 12 is closed. As illustrated; gas valve 12 is in the open position permitting the flow of gas (shown schematically by arrows 18) through gas valve 12 and gas line 19. A lock tab 20 having a hole 21 therethrough is formed as an integral part of valve stem 16 so that when valve stem 16 is rotated ninety degrees counterclockwise lock tab 20 is also rotated counterclockwise to place hole 21 into alignment with a hole 23 in a lock base 22. The alignment of hole 21 with hole 23 allows a padlock (not shown) or similar locking device to be placed on gas valve 12 to secure it in the locked position.

Valve stem 16 is configured as a raised boss 30 having a generally rectangular profile extending an incremental distance outwardly from the surface of lock tab 20. Raised boss 30 has a length 32, a width 34, and a height 36, the dimensions of each of which are standard throughout the gas valve industry for specific sizes of gas valves. Valve stem 16 includes diametrically opposed corners 33 and 35 which are engaged by tool 10 as will be discussed more fully hereinafter.

Tool 10 has a head 50 and an angled neck 52 extending from a handle 54 and is configured as a unidirectional tool operable only to close gas valve 12 by rotating valve stem 16 in a counterclockwise direction. Head 50 includes a recessed engagement receptacle 40 for releasably engaging valve stem 16. In particular, receptacle 40 is defined by an upper raised corner 42 and a lower raised corner 44. Interiorly, raised corner 42 defines an inside corner 43 while raised corner 44 defines an inside corner 45. Inside corners 43 and 45 are diametrically opposed across the surface of engagement receptacle 40 and form the engagement mechanism for valve stem 16. Engagement of valve stem 16 is done by placing receptacle 40 of tool 10 over the end of valve stem 16 with corners 33 and 35 thereof being received by internal corners 43 and 45, respectively, to thereby allow tool 10 to securely engage valve stem 16 for the purpose of rotating valve stem 16 in a counterclockwise direction toward the off position. Importantly, corresponding inside corners that would otherwise be present on engagement receptacle 40 are specifically absent so as to preclude tool 10 from being used to rotate valve stem 16 in a clockwise direction toward the open position for gas valve 12. Cutout sections 46 and 47 represent a first missing corner while diametrically opposed therefrom are cut out sections 48 and 49 which represent the other missing corner. Any attempt to rotate valve stem 16 in a clockwise direction will cause tool 10 to merely slip off valve stem 16 since there are no inside corners similar to inside corners 43 and 45 which would otherwise engage corresponding corners 37 and 39. Tool 10 is further prepared to preclude the engagement of valve stem 16 by having sloped surfaces formed on each of cutout sections 46, 47, 48, and 49. Otherwise, a person (not shown) could conceivably engage valve stem 16 diagonally across receptacle 40 between raised corners 42 and 44 and thereby possibly be able to obtain sufficient engagement thereof to turn valve stem 16 in the clockwise direction. As it is, sloped surfaces 46–49 cause tool 10 to simply rotatably slide over the external profile of valve stem 16 without engaging the same sufficiently to cause it to be turned in the clockwise direction.

Figure 2:
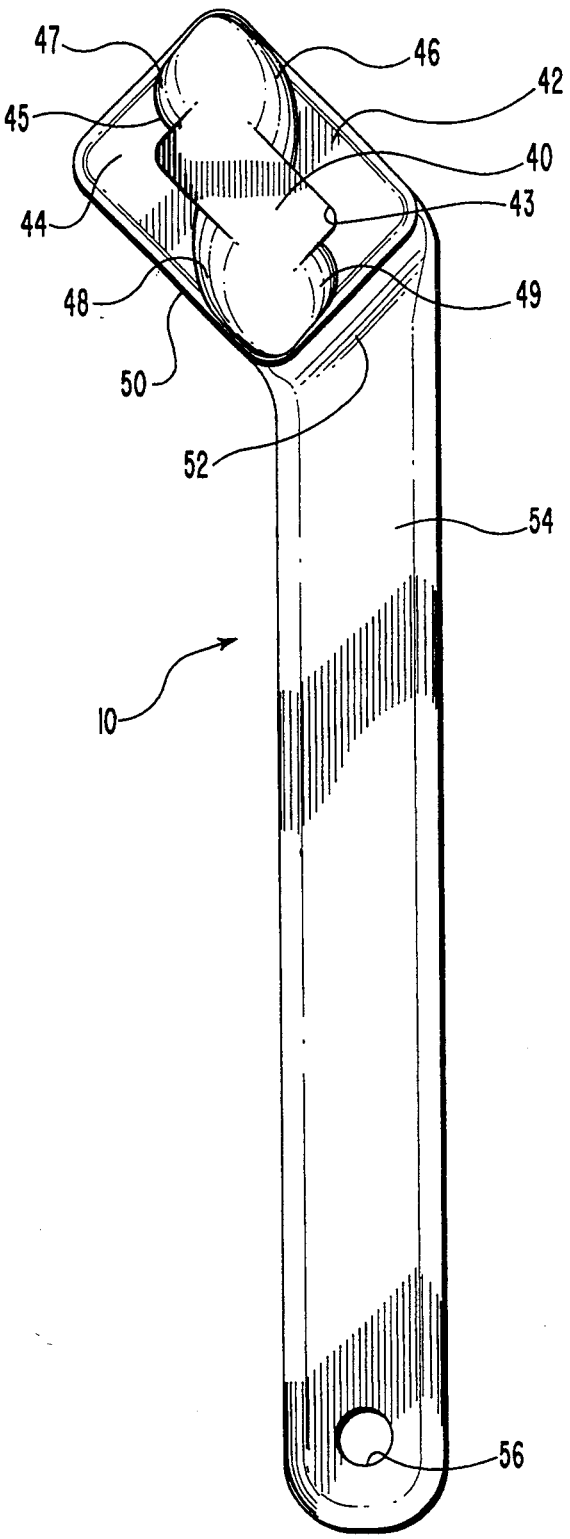
FIG. 2 is a plan view of the front of the tool.
Figure 3:
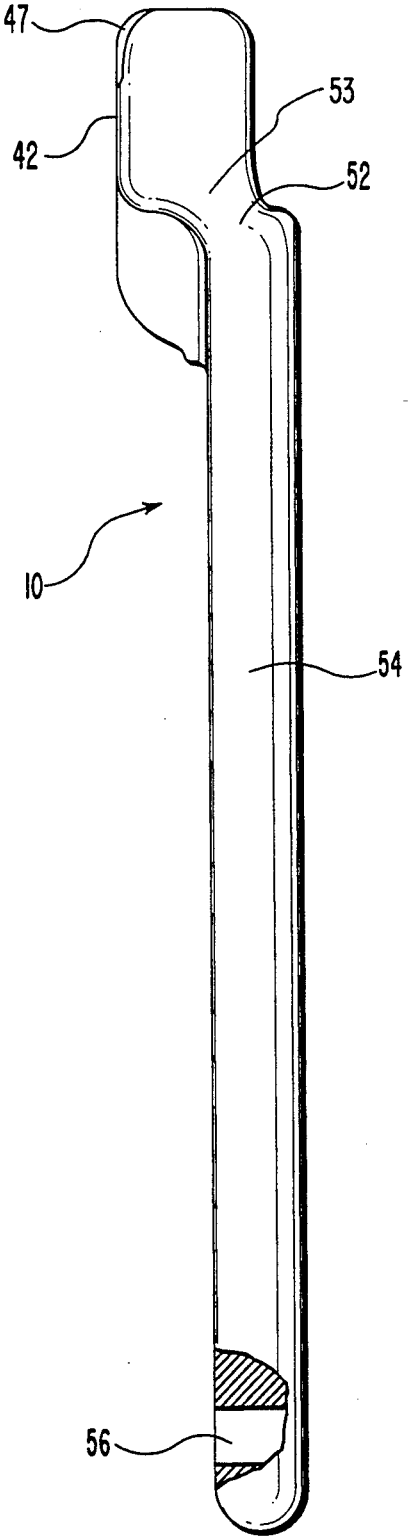
FIG. 3 is a side elevation of the tool.

Referring now also to FIGS. 2 and 3, tool 10 is shown in a plan view and a side profile, respectively, in order to more clearly illustrate the relationship between head 50 and handle 54. In particular, head 50 is formed in neck 52 which extends outwardly from handle 54 at about a 45° angle. Further, as shown in FIG. 3, neck 52 also includes an offset 53 of head 50 away from the plane of handle 54 in order to place receptacle 40 at a position where it can more easily engage valve stem 16 while holding handle 54 an incremental distance away from gas pipe 19. This configuration of tool 10 helps protect the hand (not shown) of any person using tool 10. Handle 54 includes a hole 56 in the end thereof to accommodate a lanyard or the like (not shown) for use in hanging tool 10 adjacent gas valve 12.

Tool 10 is specifically designed to be fabricated from a suitable, nonsparking material such as hard rubber, plastic, brass, aluminum, or an aluminum alloy. Aluminum is a particularly advantageous metal to use for this purpose due not only to its ease of use in casting intricate shapes but also due to its light weight and the fact that it is a nonsparking metal. A nonsparking metal is of particular importance since tool 10 is designed to be used primarily for emergency conditions wherein the integrity of the interior gas distribution system may have been compromised. Under these conditions there is a reasonable likelihood that gas 18 could be escaping in the vicinity of gas valve 12. Under this circumstance, it is entirely possible that if tool 10 were fabricated from an iron or other sparking metal the person (not shown) using tool 10 could, in the haste of the circumstance, strike tool 10 against gas valve 12 causing a spark capable of igniting gas 18 with catastrophic consequences.

Neck 52 is angularly offset from head 50 to provide an ergonomically designed configuration to tool 10. In particular, gas valve 12 in the open position means that the longitudinal orientation of valve stem 16 will be parallel to gas pipe 19 so that if handle 54 were also in alignment with the longitudinal axis of receptacle 40 and, therefore, valve stem 16, it would be necessary for the operator (not shown) to align handle 54 into alignment with gas pipe 19. This orientation would make it awkward for the operator to grasp handle 54 and thereafter also to apply sufficient force against handle 54 in order to rotate valve stem 16. As it is, neck 52 is angled sufficiently to allow the operator to engage valve stem 16 with tool 10 without any interference between gas pipe 19 and the hand of the operator.

The Method

Tool 10 is prepared by forming the dimensions of receptacle 40 and, more particularly, the spatial orientation of inside corners 43 and 45 to engagedly receive corresponding corners 33 and 35 of valve stem 16. Thus engaged, handle 54 is rotated in a counter-clockwise manner for a full ninety degrees of rotation. Such a rotation of valve stem 16 closes gas valve 12. Importantly, tool 10 is utterly useless for the purpose of rotating valve stem 16 in a clockwise rotation. This important feature is possible due to the absence of inside corners in receptacle 40 as represented by cutout sections 46–49 which could otherwise be used to engage corners 37 and 39 of valve stem 16. As it is, any attempt to rotate valve stem 16 in a clockwise direction will cause corners 33, 35, 37, and 39 to slide over the ramps created by cutout sections 46–49 thereby prohibiting tool 10 from being used to open gas valve 12.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A gas valve shutoff tool operable only to close the gas valve, the gas valve having a valve stem configured as a raised, rectangular boss extending outwardly from the gas valve comprising:

a handle for hand grasping said tool;

a head affixed to one end of said handle;

a rectangular recess in one face of said head, said rectangular recess being dimensionally configured to receive the end of the raised, rectangular boss of the gas valve stem, said rectangular recess having a first corner and a second corner diametrically opposed to said first corner, said first corner and said second corner cooperatingly engaging corresponding corners of the raised, rectangular boss of the gas valve stem to permit rotation of the raised, rectangular boss of the gas valve stem upon the application of a torque against said head by rotation of said handle, said recess having a pair of diametrically opposed cutout portions in place of corners that would otherwise correspond to said first corner and said second corner.

2. The gas valve shutoff tool defined in claim 1 wherein said handle includes an angled neck between said head and said handle, said angled neck orienting said head at an angular orientation relative to said handle.

3. The gas valve shutoff tool defined in claim 2 wherein said neck includes an offset to hold said head in a first plane parallel to and offset from a second plane of said handle.

4. The gas valve shutoff tool defined in claim 1 wherein said tool is fabricated from a nonsparking material.

5. The gas valve shutoff tool defined in claim 1 wherein said handle includes a hole to accommodate suspending said tool adjacent the gas valve.

6. The gas valve shutoff tool defined in claim 1 wherein said head is configured as a block having a generally rectangular profile with said recess forming an open receptacle in said face, said cutout portions extending between the interior of said receptacle and the exterior of said block.

7. A unidirectional shutoff tool for a gas valve having a raised, rectangular boss extending outwardly from the body of the gas valve, the rectangular boss forming an extension of the valve stem and being rotatable to selectively open and close the gas valve, the raised, rectangular boss having a first corner, a second corner, a third corner and a fourth corner, the first corner being diametrally opposed from the third corner and the second corner being diametrically opposed from the fourth corner, said unidirectional shutoff tool comprising:

a handle, said handle having a first end and a second end and configured to be grasped by hand;

a neck at said first end of said handle, said neck being angled outwardly from said handle;

a head on said neck, said head having a block-like profile; and a rectangular recess in a face of said block-like profile of said head, said recess being dimensionally configured to receive therein the raised, rectangular boss of the valve stem for the gas valve, said recess being characterized by the presence of two, diametrically opposed engagement corners operable to unidirectionally engage the corresponding first and third corners of the raised, rectangular boss thereby enabling said unidirectional shutoff tool to close the gas valve, said recess also including two, diametrically opposed cutout portions with each cutout portion representing the absence of a corner of said rectangular recess said cutout portions being configured to receive the corresponding second and fourth corners of the raised, rectangular boss thereby inhibiting said unidirectional shutoff tool from being used to rotate the valve stem of the gas valve in a reverse direction.

8. The unidirectional shutoff tool defined in claim 7 wherein neck includes a planar offset to support said head in a plane parallel to and incrementally offset from the plane of said handle, said offset holding said rectangular recess in an orientation directed outwardly from said handle.

9. The unidirectional shutoff tool defined in claim 7 wherein said tool is fabricated from a suitable nonsparking material.

10. The unidirectional shutoff tool defined in claim 7 wherein said handle includes a hole in said second end to accommodate releasably suspending said tool adjacent the gas valve.

* * * * *